US005267361A

United States Patent [19]

Lai

[11] Patent Number: 5,267,361

[45] Date of Patent: Dec. 7, 1993

[54] DRAIN TRAP

[75] Inventor: Shu-Ying Lai, Taipei, Taiwan

[73] Assignee: Hocheng Pottery Mfg. Co., Ltd., Taipei, Taiwan

[21] Appl. No.: 40,511

[22] Filed: Mar. 31, 1993

[51] Int. Cl.[5] ..... E03C 1/282

[52] U.S. Cl. ..... 4/679; 137/247.51; 210/435; 4/256.1

[58] Field of Search ..... 4/674, 681, DIG. 14, 4/256.1; 210/435, 437, 447; 137/247.41, 247.43, 247.47, 247.49, 247.51

[56] References Cited

U.S. PATENT DOCUMENTS

| | | | |
|---|---|---|---|
| 1,217,763 | 2/1917 | Hirrich | 137/247.41 X |
| 1,679,033 | 7/1928 | Holmes | 210/447 |
| 1,817,376 | 8/1931 | Izgierdo | 4/679 X |
| 2,690,232 | 9/1954 | Brem | 4/DIG. 4 X |
| 3,935,602 | 2/1976 | Kale | 210/435 X |
| 4,032,455 | 6/1977 | Kale | 4/679 X |
| 4,164,048 | 8/1979 | Kampfer et al. | 4/DIG. 4 X |
| 4,179,762 | 12/1979 | Barnhardt et al. | 4/679 |
| 4,230,582 | 10/1980 | Tuleja | 210/435 |
| 4,301,554 | 11/1981 | Wojcicki | 4/679 |
| 4,539,718 | 9/1985 | Haer | 210/435 X |

*Primary Examiner*—Charles E. Phillips
*Attorney, Agent, or Firm*—Morgan & Finnegan

[57] ABSTRACT

A drain trap includes an L-shaped inlet tube, a cap, a vertical discharge tube and a garbage blocking member. The inlet tube includes a vertical portion, a horizontal portion having an end integral with the lower end of the vertical portion, an open upper end and an open lower end. The cap closes the open lower end of the inlet tube so that water falling from the open upper end of the inlet tube strikes an inner wall of the cap. The discharge tube has an open upper end and is connected securely to the upper surface of an intermediate section of the horizontal portion of the inlet tube so that the drain trap is generally F-shaped, thereby defining a return area in the horizontal portion of the inlet tube near the cap. The return area permits water that is blocked by the inner wall of the cap to flow upward into the discharge tube. The garbage blocking member is fitted detachably in the intermediate section of the horizontal portion of the inlet tube under the discharge tube. Accordingly, water flows through the garbage blocking member from the inlet tube to the discharge tube two times so as to hold garbage on the garbage blocking member for disposal.

5 Claims, 3 Drawing Sheets

DRAIN TRAP

BACKGROUND OF THE INVENTION

1. Field of the Invention

This invention relates to a drain trap, more particularly to a drain trap which has a garbage blocking member fitted detachably therein.

2. Description of the Related Art

Referring to FIG. 1, a conventional drain trap (1) has a vertical inlet portion (11), a trap portion (12), and a horizontal discharge portion (13). One end of the trap portion (12) is formed integral with the inlet portion (11), while the other end of the trap portion (12) is integral with the discharge portion (13). The trap portion (12) has a cleanout (121) formed in the lower surface thereof and a cap (122) mounted removably on the trap portion (12) so as to close the cleanout (121). Because the trap portion (12) is connected to the lower ends of the discharge portion (13) and the inlet portion (11), when water flows from the inlet portion (11), garbage accumulates in the trap portion (12) for disposal so as to prevent the garbage from blocking the drain trap (1). However, water from the inlet portion (11) may push the garbage accumulated in the trap portion (12) to the discharge portion (13), thereby blocking the discharge portion (13).

SUMMARY OF THE INVENTION

The main object of this invention is to provide a drain trap which has a return area formed therein and a garbage blocking member fitted detachably therein so as to hold garbage on the garbage blocking member for disposal.

According to this invention, a drain trap includes an L-shaped inlet tube, a cap, a vertical discharge tube and a garbage blocking member. The inlet tube has a vertical portion, a horizontal portion having an end formed integral with the lower end of the vertical portion, an open upper end and an open lower end. The cap closes the open lower end of the inlet tube so that water falling from the open upper end of the inlet tube strikes an inner wall of the cap. The discharge tube has an open upper end and is connected securely to the upper surface of an intermediate section of the horizontal portion of the inlet tube so that the drain trap is generally F-shaped, thereby defining a return area in the horizontal portion of the inlet tube near the cap. The retain area permits water that is blocked by the inner wall of the cap to flow upward into the discharge tube. The garbage blocking member is fitted detachably in the intermediate section of the horizontal portion of the inlet tube under the discharge tube. Accordingly, water flows through the garbage blocking member from the inlet tube to the discharge tube two times so as to hold garbage on the garbage blocking member for disposal.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
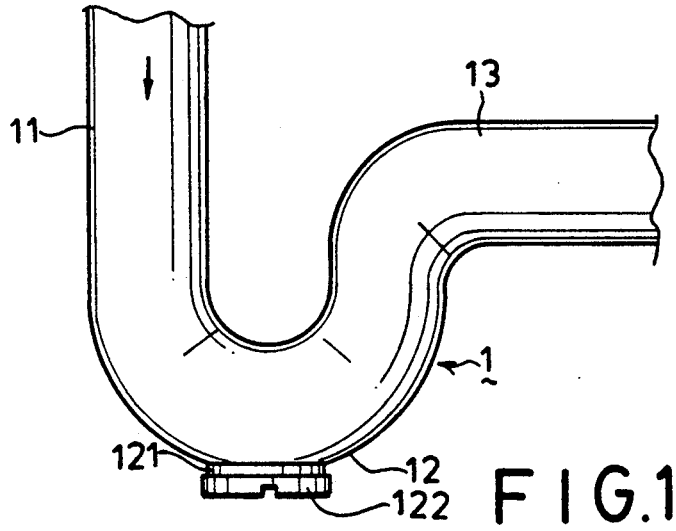
FIG.1 PRIOR ART
FIG. 1 is a perspective view of a conventional drain trap.
Figure 2:
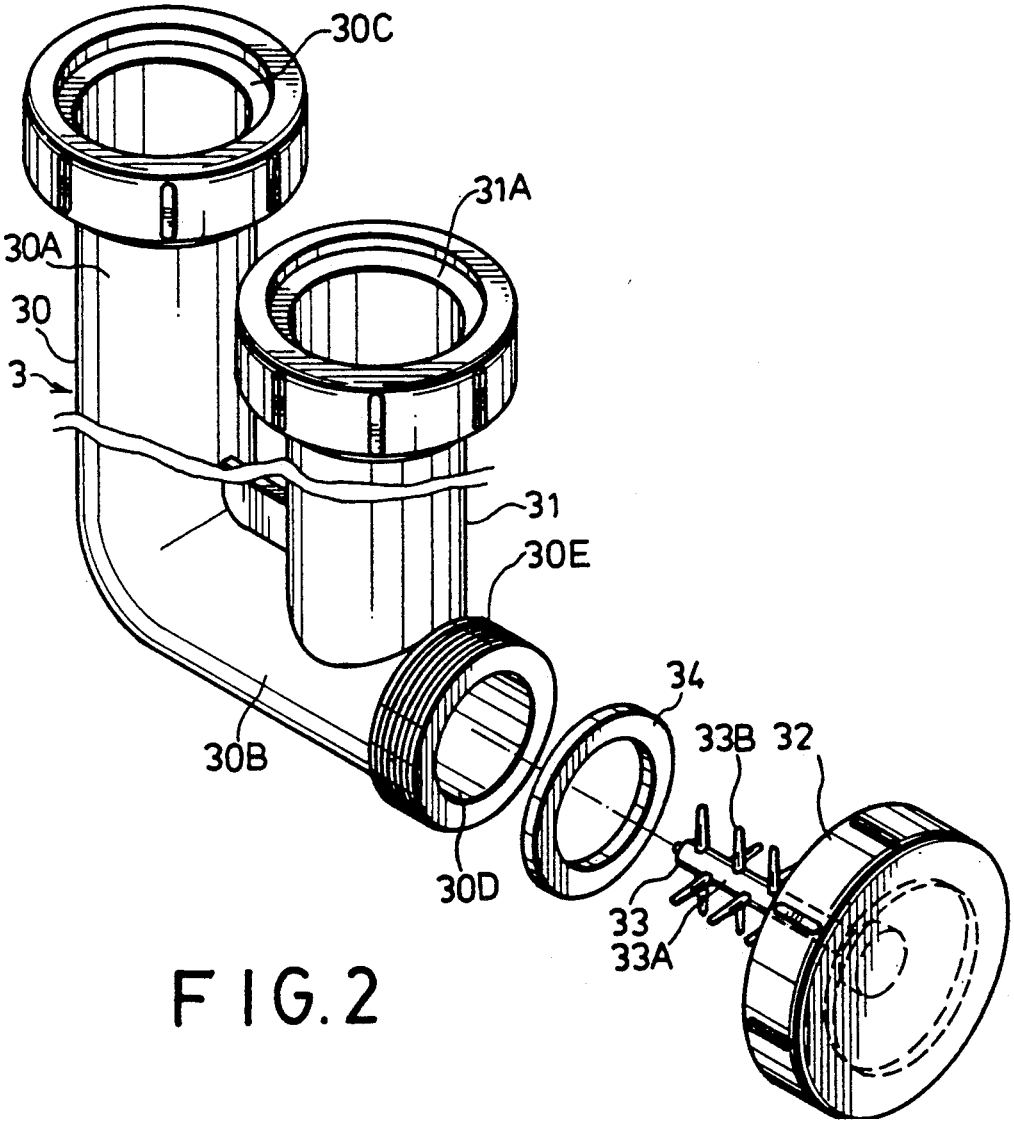
FIG. 2 is an exploded view of a drain trap according to this invention.
Figure 3:
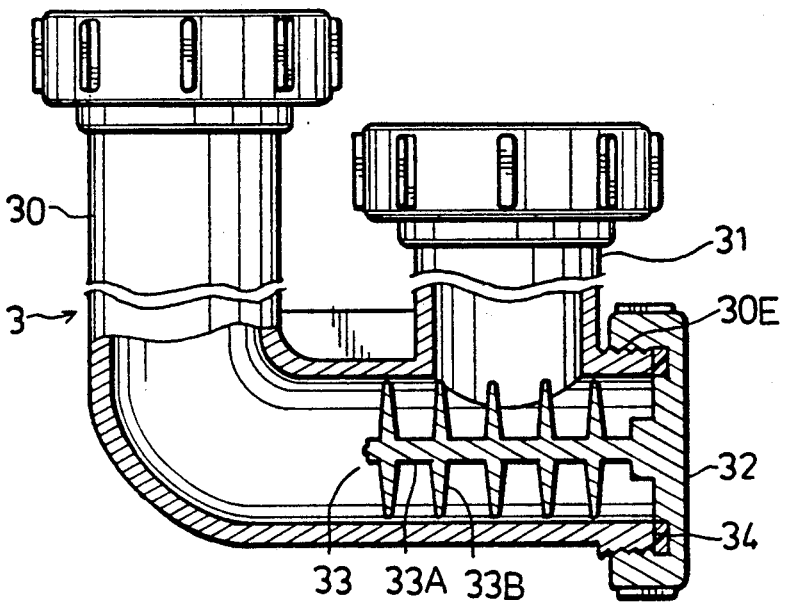
FIG. 3 is an assembled view showing the drain trap of this invention.

Referring to FIGS. 2 and 3, a drain trap (3) of this invention includes an L-shaped inlet tube (30), a vertical discharge tube (31), an internally threaded cap (32), and a garbage blocking member (33). The inlet tube (30) includes a vertical portion (30A), a horizontal portion (30B) having an end formed integral with the lower end of the vertical portion (30A), an open upper end (30C) located on the vertical portion (30A), and an open lower end (30D) located on the horizontal portion (30B). The lower end (30D) of the inlet tube (30) has an external thread portion (30E) so that the cap (32) is engaged threadably with the external thread portion (30E). A gasket (34) is disposed between the inlet tube (30) and the cap (32) so as to establish a liquid-tight seal therebetween.

Figure 4:
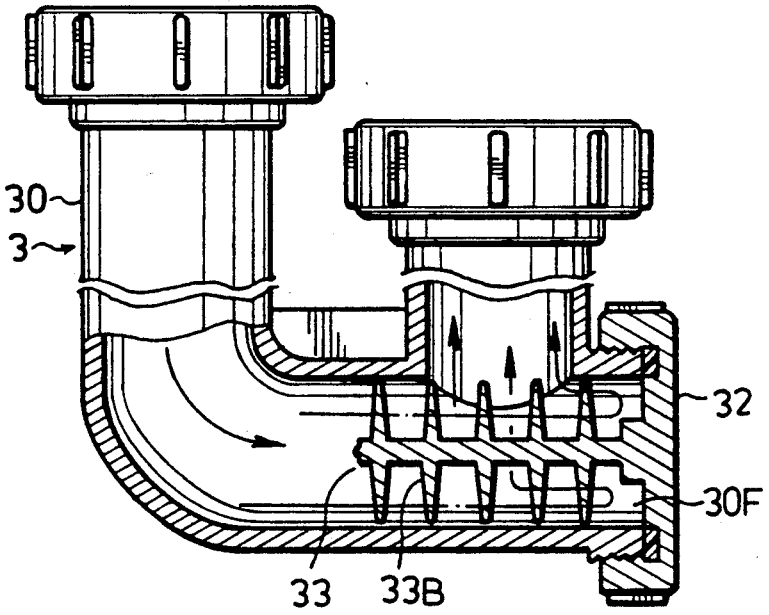
FIG. 4 is a schematic view illustrating the flow path of water through the drain trap in accordance with this invention.

Referring to FIG. 4, water falling from the vertical portion (30A) of the inlet tube (30) strikes an inner wall of the cap (32). The discharge tube (31) has an open upper end (31A) and is connected securely to the upper surface of an intermediate section of the horizontal portion (30B) of the inlet tube (30) so that the drain trap (3) is generally F-shaped, thereby defining a return area (30F) in the horizontal portion (30B) of the inlet tube (30) near the cap (32). The return area (30F) permits water that is blocked by the inner wall of the cap (32) to flow upward into the discharge tube (31). The garbage blocking member (33) is connected securely to the inner wall of the cap (32) and has a horizontal central rod (33A) and a plurality of elongated projections (33B) that extend radially and uniformly from the central rod (33A). The garbage blocking member (33) is fitted in the intermediate section of the horizontal portion (30B) of the inlet tube (30) under the discharge tube (31).

Referring to FIG. 4, when water flowing from the vertical portion (30A) of the inlet tube (30) strikes the inner wall of the cap (32), water flows upward into the discharge tube (31) because water pressure in the return area (30F) is higher than that in the discharge tube (31). Accordingly, water flows through the garbage blocking member (36) twice so as to hold garbage on the garbage blocking member (33).

Figure 5:
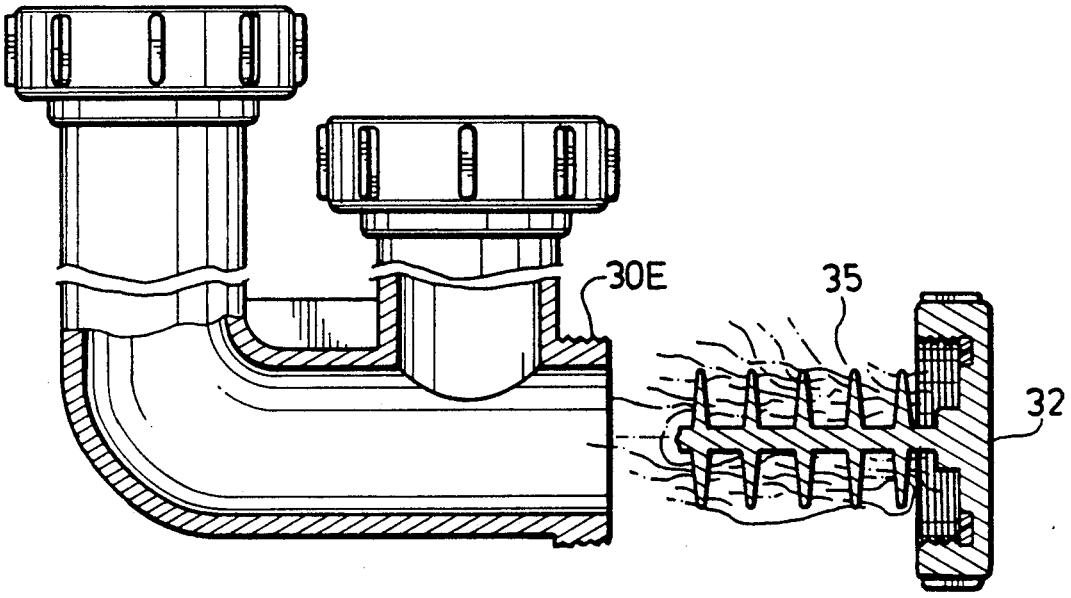
FIG. 5 is a schematic view illustrating how the drain trap of this invention is cleaned.

Referring to FIG. 5, the garbage blocking member (33) can be removed from the inlet tube (30) so as to remove garbage (35) held on the blocking member (33).

With this invention thus explained, it is apparent that numerous modifications and variations can be made without departing from the scope and spirit of this invention. It is therefore intended that this invention be limited only as indicated in the appended claims.

I claim:

1. A drain trap comprising:

an L-shaped inlet tube including a vertical portion, a horizontal portion having an end formed integral with a lower end of said vertical portion, an open upper end located on said vertical portion, and an open lower end located on said horizontal portion;

a cap closing said lower end of said inlet tube that water falling from said vertical portion of said inlet tube strikes an inner wall of said cap;

a vertical discharge tube having an open upper end and being connected securely to an upper surface of an intermediate section of said horizontal portion of said inlet trap so that said drain tube is generally F-shaped, thereby defining a return area in said horizontal portion of said inlet tube near said cap, said return area permitting water that is blocked by said inner wall of said cap to flow upward into said discharge tube;

a garbage blocking member fitted detachably in said intermediate section of said horizontal portion of said inlet tube under said discharge tube;

whereby, water flows through said garbage blocking member from said inlet tube to said discharge tube twice so as to hold garbage on said garbage blocking member for disposal.

2. A drain trap as claimed in claim 1, wherein said cap is mounted removably on said inlet tube.

3. A drain trap as claimed in claim 2, wherein said cap is engaged threadably with said lower end of said inlet tube, said cap including a gasket disposed between said inlet tube and said cap so as to establish a liquid-tight seal therebetween.

4. A drain trap as claimed in claim 2, wherein said garbage blocking member is connected securely to said inner wall of said cap.

5. A drain trap as claimed in claim 1, wherein said garbage blocking member includes a horizontal central rod and a plurality of elongated projections extending radially and uniformly from said central rod.

* * * * *